United States Patent [19]

Parnello

[11] Patent Number: 4,472,010

[45] Date of Patent: Sep. 18, 1984

[54] TWIST-INHIBITING APPLIANCE FOR CONNECTING A CABLE OF A TELEPHONE SET OR THE LIKE

[76] Inventor: Nicholas G. Parnello, 1295 N. Main St., Rockford, Ill. 61103

[21] Appl. No.: 462,461

[22] Filed: Jan. 31, 1983

[51] Int. Cl.[3] ..... H01R 39/08

[52] U.S. Cl. ..... 339/8 R; 339/154 A; 339/176 M

[58] Field of Search ..... 339/8 R, 8 P, 154 A, 339/176 M

[56] References Cited

U.S. PATENT DOCUMENTS

| | | | |
|---|---|---|---|
| 2,200,794 | 5/1940 | Krantz | 339/8 R |
| 2,265,846 | 12/1941 | Krantz | 339/8 R |
| 2,645,759 | 7/1953 | Solari | 339/8 P |
| 3,321,728 | 5/1967 | Cocco et al. | 339/8 P |
| 4,061,380 | 12/1977 | Carnahan et al. | 339/8 R |

*Primary Examiner*—Eugene F. Desmond

*Attorney, Agent, or Firm*—Leydig, Voit, Osann, Mayer & Holt, Ltd.

[57] ABSTRACT

A telephone set includes a coiled multi-conductor cable connected to an assembly such as a handset by a standard modular connector and an appliance is interposed in the connector to inhibit twisting of the cable. The appliance includes two parts which freely rotate relative to each other with one part receiving the male element of the connector and the other part being inserted into the female element of the connector so that, rather than the cable twisting, the parts of the appliance rotate relative to each other. The electrical connection between the conductors in the cable and conductors in the handset is maintained by cooperating contacts on the other part and on the female element and by wipers carried by one of the parts and engaging conductive rings on the other part.

7 Claims, 7 Drawing Figures

TWIST-INHIBITING APPLIANCE FOR CONNECTING A CABLE OF A TELEPHONE SET OR THE LIKE

BACKGROUND OF THE INVENTION

This invention relates to a telephone set or the like which includes a multi-conductor cable extending between a handset and a base and, more particularly, to such an arrangement where at least one end of the cable is connected by means of a standard modular connector which includes interfitting male and female elements. During use, the cable becomes progressively twisted and eventually it becomes tangled. As a result, the user is put to the nuisance of manually untangling and untwisting the cable.

SUMMARY OF THE INVENTION

The general object of the invention is to take advantage of the modular connector and to interpose in this connector an appliance which automatically compensates for any tendency of the cable to twist and, at the same time, maintains the electrical connections which normally are coupled by the connector.

A more detailed object is to provide a connector which is made of two parts rotatable relative to each other as the cable tends to twist with one part receiving the male element of the conductor and the other part insertable into the female element and to maintain the electrical connections through conductive rings supported on one part and engaged by wipers carried by the other part.

The invention also resides in the novel construction of the parts of the appliance and in the details of the conductive rings and wipers.

DETAILED DESCRIPTION OF THE PREFERRED EMBODIMENTS

Figure 1:
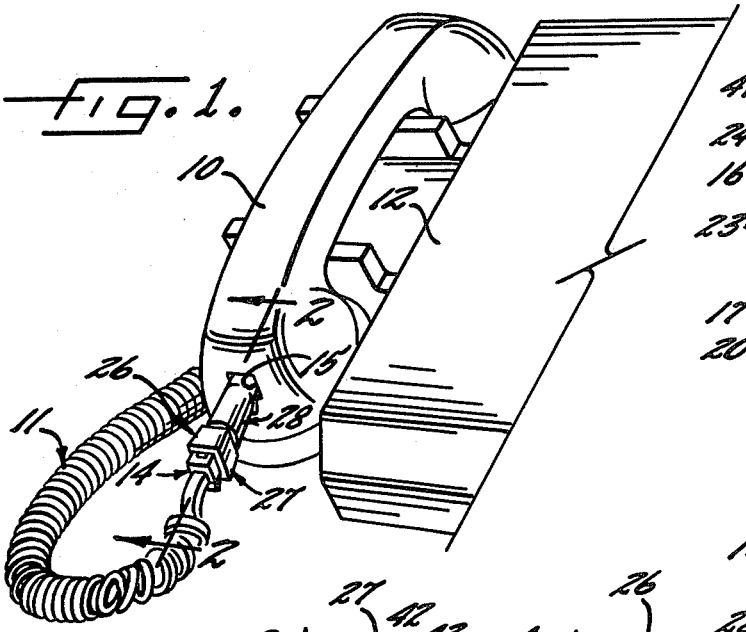
FIG. 1 is a perspective view of a telephone set utilizing a twist inhibiting appliance embodying the present invention.

As shown in the drawings for purposes of illustration, the invention is adapted for use with a telephone set which includes a handset 10 connection by a coiled multi-conductor cable 11 to a conventional base 12. At least one end of the cable is connected to the corresponding part of the telephone set by a standard modular connector and, in the form shown, the cable is coupled to the handset by such a connector. As is customary in the art, the latter comprises a female element 13 and a male element 14 received in a hole 15 in the female element. Herein, the female element is formed as a part of the mouthpiece end of the handset 10 and the male element is attached to the end of the cable 11. In order that the connector elements are properly oriented relative to each other when the male element is inserted in the female element, the male element includes an upper portion 16 (FIG. 3) which is rectangular in cross section and a lower portion 17 which also is rectangular in cross section but is smaller than the upper portion and the hole 15 of the female element is complemental in shape to the male element. The latter customarily is molded from a plastic material and includes an integral spring finger 18 which projects rearwardly and is received in a notch 19 in the lower edge of the hole 15. The forward portion of the finger is wider than the notch to provide rearwardly facing shoulders 20 so that the finger yeilds and enters the hole above the notch and then snaps down into the notch whereby the shoulders hold the two elements 13 and 14 releasably together.

Figure 3:
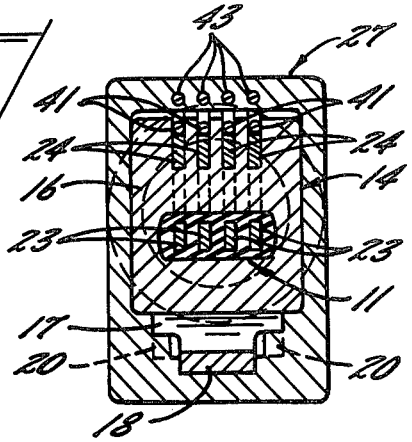
FIG. 3 is a sectional view taken along the line 3—3 in FIG. 2.

The cable 11 includes a plurality of wires 21, herein four, which are coupled by the connector to the same number of conductors 22 (FIG. 2) in the handset 10. For this purpose, each wire 21 is physically and electrically connected to a flat terminal 23 embedded in the male element 14 and formed with an edge 24 which is externally exposed through one side of the male element. The terminals are disposed side by side as shown in FIG. 3 and, when the male element is received in the hole 15, each is engaged by a corresponding terminal 25 in the hole. Each terminal 25 is conductive resilient wire which projects downwardly and inwardly from the upper wall of the hole and which is electrically connected to one of the conductors 22 in the handset 10. Thus, as the male element 14 is inserted in the hole 15, the wire terminals 25 are resiliently bent upwardly so that they bear in firm electrical contact with the edges 24 of the terminals 23 and complete the connections between the conductors in the cable and the conductors in the handset.

As telephones are used, the cable 11 become progressively twisted and, when the twisting is great enough, the cable becomes tangled. Such twisting and tangling is undesirable because, among other things, it is difficult to hold the handset 10 the desired distance from the base when using the telephone. Also, the twisting causes the cable to deteriorate and shortens its useful life. With prior arrangements, untwisting the cable is basically a manual job and, because most people consider it s nuisance to do, the cable is untwisted infrequently.

In accordance with the present invention, advantage is taken of the modular connector 13, 14 to provide an arrangement which virtually prevents the cable 11 from twisting as the telephone set is used. To this end, an appliance or auxiliary connector 26 is interposed between and interfits with the male and female elements 13 and 14 and the appliance is composed of two parts 27 and 28 which are captivated one within the other and are free to rotate relative to each other about a longitudinal axis a. At the same time, the connection between the wires 21 of the cable 11 and the conductors 22 in an assembly such as the handset 10 is maintained by a plurality of wipers 29 which are mounted on one of the parts and slidably engage conductive rings 30. The latter are carried by the other of the parts 27 and 28 and are concentric with the axis a. Thus, when there is a tendency for the cable 11 to twist, the parts 27 and 28 will turn relative to each other instead and this will occur without interrupting the electrical circuits through the elements 13 and 14 and the auxiliary connector 26.

In the form shown in FIGS. 1 through 5, each of the parts 27 and 28 of the auxiliary connector 26 is molded from a rigid plastic material such as nylon and these parts are disposed end to end along the axis a with the part 27 being adapted to receive the male element 14 and the part 28 being adapted for insertion in the female element 13. Projecting forwardly from the front wall 31 of the part 27 and molded integrally therewith is a shaft 32 which is coaxial with the axis a and which projects into a bore 33 opening through the rear end of the part 28. A radial flange 34 is formed on the shaft and is spaced outwardly a short distance from the wall 31 and an annular recess 35 formed in the part 28 around the bore 33 receives the flange. The material from which the parts are molded is resilient and the rear end portion of the part 28 is slotted as indicated at 36 (FIGS. 2 and 5) to permit the flange to be snapped into the recess as the shaft 32 is being inserted in the bore 33 and, when the parts are thus interfitted, they may turn relative to each other about the axis a.

Figure 4:
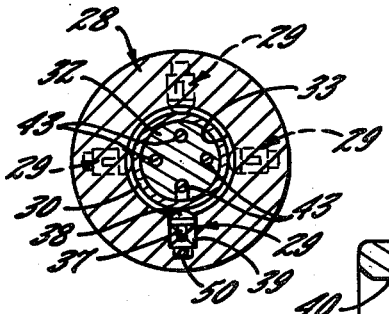
FIG. 4 is a sectional view taken along the line 4—4 in FIG. 2.
Figure 5:
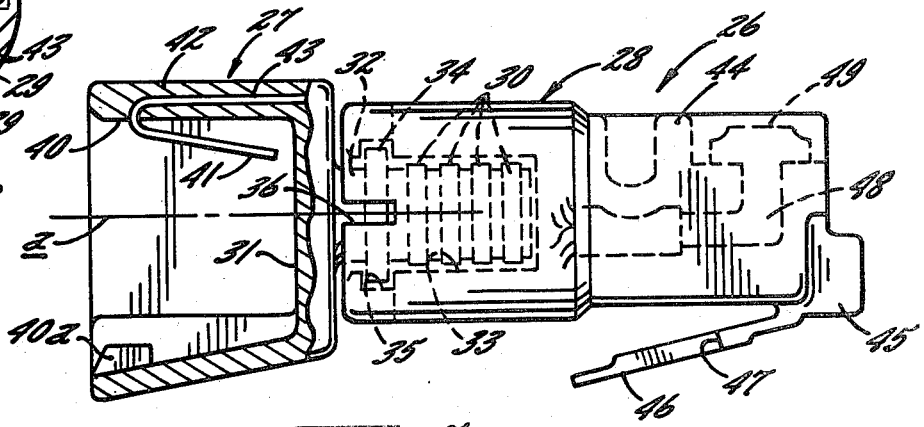
FIG. 5 is an enlarged view of the appliance with parts broken away and shown in section.

Herein, the rings 30, which are made of a conductive material such as copper, are spaced along the shaft 32 between the outer end of the latter and the flange 34 and the rings encircle the circumference of the shaft. There are four such rings, one for each wire 21 of the cable 11, and each ring is engaged by one of the wipers 29 which are mounted on the part 28 along the bore 33. As shown in FIG. 4, each wiper is a small cylindrical stud received in a hole 37 in the wall of the bore 33 and formed with a head 38 which engages the corresponding ring 30. Each stud is urged radially inwardly and into engagement with its ring by a coiled compression spring 39 which encircles the stud and acts between the underside of the head 38 and the bottom of the hole 37. The fit between the shaft and the bore is such that the two parts 27 and 28 may turn freely relative to each other while the wipers 29 remain in firm conductive contact with the rings 30.

Figure 2:
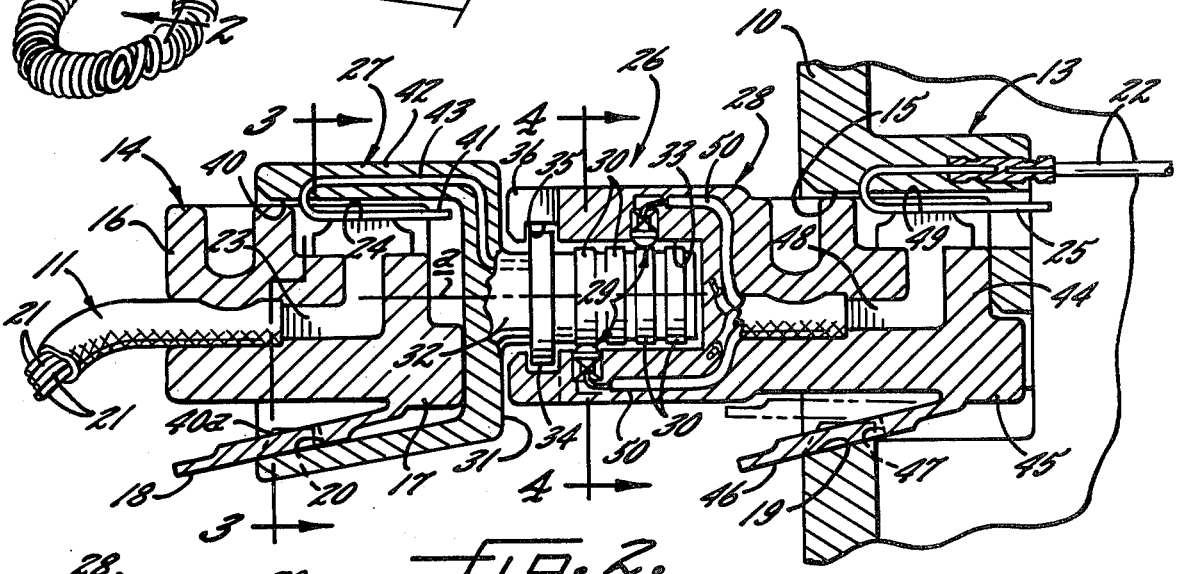
FIG. 2 is an enlarged fragmentary sectional view taken along the line 2—2 in FIG. 1.

In order that the standard modular connector may be utilized to employ the auxiliary connector 26, the part 27 is hollow to define a hole 40 which faces rearwardly and which is substantially the same in size and cross section as the hole 15 in the female element 13. As a result, the male element 14 is received in the hole 40 and interfits with the part 27 in the same manner as it would be received in the hole 15 and interfit with the female element 13, the shoulders 20 engaging the part 27 behind a notch 40*a* which is like the notch 19. Similarly, four resilient wire terminals 41, which are basically the same as its terminals 25, project inwardly and forwardly from a wall 42 of the part 27 to be engaged by the terminal edge 24 in the male element as the latter is inserted in the hole 40. Each of the wire terminals 41 is connected to one of of the rings 30 by a conductor 43 which is embedded in the part 27 and extends through the walls 42 and 31 of the part and then through the shaft 32 (FIGS. 2 and 4).

In a like manner, the forward half of the part 28 is formed to be of substantially the same size and cross section as the male element 14 so that this half may be inserted in the hole 15 in the female element 13 and interfit with the latter in the same manner as would the male element. Thus, this half of the part includes portions 44 and 45 which are rectangular in shape and are similar in size and cross section respectively to the portions 16 and 17 of the male element and a spring finger 46 similar to the finger 18 is molded integrally with the part 28 to enter the notch 19 and has shoulders 47 which hold the auxiliary connector 26 and the female element 13 releasably together. Four flat terminals 48 similar to the terminals 23 are embedded in the larger rectangular portion 44 of the front part with their edges 49 exposed for engagement with the wire terminals 25 in the female element and the terminals 48 are connected to individual ones of the wipers 29 by wires 50 which also are embedded in the part 28. Thus, when the male element 14 is coupled to the auxiliary connector 26 and the latter is coupled to the female element 13, the part 27 turns in the part 28 upon any tendency of the cable 11 to twist and, during such turning, the electrical connection between the cable wires 21 and the conductors 22 in the handset 10 is maintained by the wipers 29 engaging the rings 30.

Figure 6:
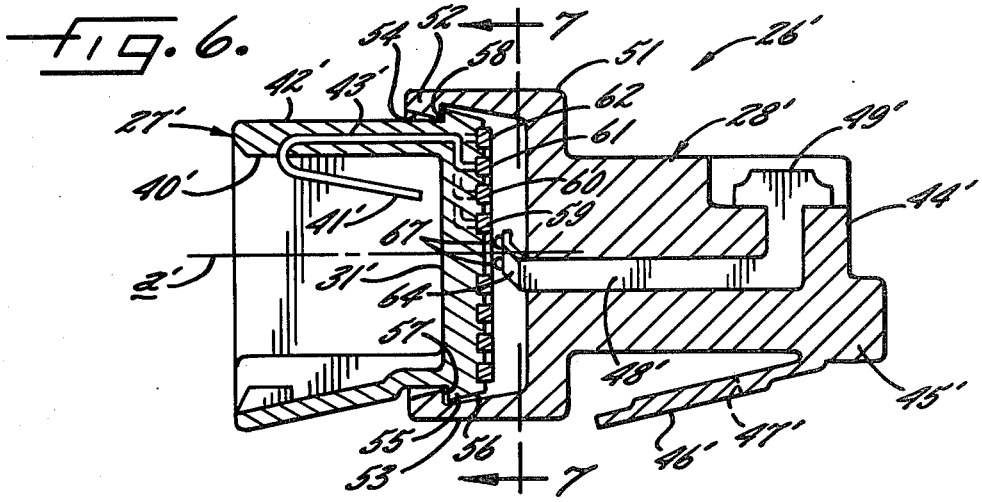
FIG. 6 is a view similar to FIG. 2 but showing a modified form of the invention.
Figure 7:
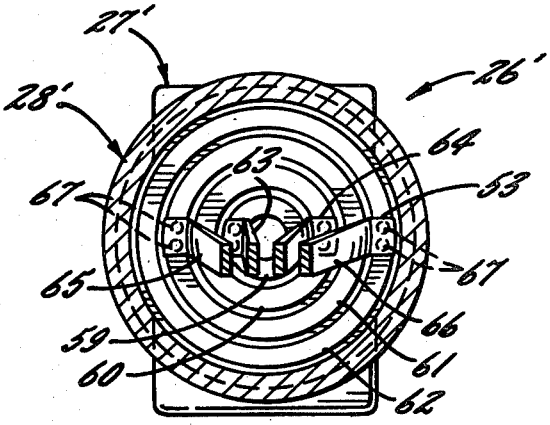
FIG. 7 is a sectional view taken along the line 7—7 in FIG. 6.

FIGS. 6 and 7 illustrate a modified form of the invention in which similar parts are identified by the same but primed reference characters. Thus, the auxiliary connector 26' in this form includes two molded plastic parts 27' and 28' disposed end to end concentrically with the axis a'. As in the first embodiment, the part 27' is formed with a rearwardly opening hole 40' of a size and shape complemental to the size and shape of the male element 14 to receive and interfit with the latter. Also, wire contactors 41' project inwardly and forwardly from the wall 42' of the part 27' to engage the contactors 23 in the male element. As to the part 28', the forward half is sized and shaped like the male element 14 so that this half may be received in and interfit with the female element 13. Further, embedded in this forward half are four flat terminals 48' with exposed edges 49' which engage the wire terminals 22 in the female element.

To couple the parts 27' and 28' for rotation relative to each other, the rear end portion 51 of the part 28' is in the form of a rearwardly opening cup with a radial flange 52 formed on the inside of the rear end of the wall 53 of the cup and having an inner surface 54 which is tapered inwardly and forwardly. A second radial flange 55 is formed on the forward end of the part 27' and has a conical surfacd 56. The diameter of the forward end of the flange 55 is smaller than the internal diameter of the flange 52 at the rear end thereof and the rear of the flange 55 is larger in diameter than the forward end of the flange 52. Thus, the parts are assembled by inserting the flange 55 into the flange 52 and then forcing the two flanges past each other, the parts resiliently yielding to permit this. When the parts are assembled, opposed shoulders 57 and 58 on the flanges 52 and 55 respectively abut each other to keep the parts coupled while permitting them to rotate freely relative to each other.

In the modified form, the conductive rings are concentric circles 59, 60, 61 and 62 mounted on the front side of the forward end wall 31' of the part 27'. Embedded in the end wall 31' and the side wall 42' of the part 27' are conductors 43' which connect the circular rings individually with the wire contacts 41'. Spring fingers 63, 64, 65 and 66 (FIG. 7) are formed integrally with contacts 48' in the part 28' and the free ends of these fingers oppose the rings 59, 60, 61 and 62 respectively. Carried by the free end of each finger is a double-tip wiper contact 67 which engages the corresponding one of the rings and is held in engagement with the latter by the resiliency of the finger.

It will be observed that, with the arrangement described above, a virtually twist-free cable or cord 11 is obtained simply by interposing the auxiliary coupling 26 in a standard modular connector, that is, by inserting the male element 14 in the part 27 and by inserting the part 28 in the female element 13. Any tendency of the cable to twist results in the part 27 turning in the part 28 rather than in twisting of the cable. At the same time, engagement of the wipers 29 (or 67) with the rings 30 (or 59 through 62) maintains the electrical connection between the conductors 21 in the cable 11 and the conductors 22 in an assembly such as the telephone handset 10.

I claim:

1. A twist-inhibiting appliance for use on a telephone set or the like which has a multi-conductor cable extending from a base to a handset with first male and female modular connector elements normally adapted to interfit with each other at end of said cable, each of said elements having a preselected number of externally exposed terminals with the terminals on one element engaging the terminals on the other when the terminals interfit, said appliance having, in combination, first and second parts with one part captivated within the other and with one part free to rotate about a longitudinal axis relative to the other part, a second male modular connector element at the extremity of one of said parts adapted to interfit with said first female element, a second female modular connector element at the extremity of the other of said parts adapted to interfit with said first male element, said second elements each having externally exposed terminals engageable with the terminals on the corresponding ones of said first elements, a plurality of rings carried by said first part and electrically connected to the respective terminals of the element on such part, a plurality of wipers carried by said second part and electrically connected to the respective terminals of the element on such part, said wipers being respectively in sliding contact with the rings on said first part as the two parts turn relatively about said axis whereby the male and female elements of said appliance may be plugged into the female and male elements of said telephone set to maintain the original connections of said cable but with any twisting of said cable being automatically removed by relative rotation of said parts.

2. The appliance set forth in claim 1 further including spring means biased to resiliently urge said wipers into pressure engagement with said rings.

3. The appliance as set forth in claim 2 further characterized in that said rings are concentric with said axis and said spring means are biased as an incident to captivating said one part within the other part.

4. A twist-inhibiting appliance for use on a telephone set or the like which has a multi-conductor cable extending from a base to a handset with first male and female modular connector elements normally adapted to interfit with each other at one end of said cable, each of said elements having a preselected number of externally exposed terminals with the terminals on one element engaging the terminals on the other when the terminals interfit, said appliance having, in combination, first and second parts with one part having a radial flange captivated within the other and with one part free to rotate relative to the other part about the longitudinal axis of said flange, a second male modular connector element at the extremity of one of said parts adapted to interfit with said first female element, a second female modular connector element at the extremity of the other of said parts adapted to interfit with said first male element, said second elements each having externally exposed terminals engageable with the terminals on the corresponding ones of said first elements, a plurality of conductive rings carried concentrically with said axis by said first part and electrically connected to the respective terminals of the element on such part, a plurality of conductive wipers carried by said second part and electrically connected to the respective terminals of the element on such part, said wipers being respectively in sliding contact with the rings on said first part as the two parts turn relatively about said axis, whereby the male and female elements of said appliance may be plugged into the female and male elements of said telephone set to maintain the original connections of said cable but with any twisting of said cable being automatically removed by relative rotation of said parts.

5. An appliance as defined in claim 4 in which said rings are equal in diameter and are axially spaced along said axis and spring means urges said wipers radially into engagement with said rings.

6. An appliance as defined in claim 4 in which said rings are concentric with each other and face axially and spring means urges said wipers axially into engagement with said rings.

7. An appliance as defined in claim 4 in which said flange is received in an annular space formed in said other part and said other part is resilient to yield and permit said flange to enter said space during assembly.

* * * * *

REEXAMINATION CERTIFICATE (1131st)

United States Patent [19] [11] B1 4,472,010

Parnello [45] Certificate Issued Sep. 26, 1989

[54] TWIST-INHIBITING APPLICANCE FOR CONNECTING A CABLE OF A TELEPHONE SET OR THE LIKE

[76] Inventor: Nicholas G. Parnello, 1295 N. Main St., Rockford, Ill. 61103

Reexamination Request:
No. 90/001,120, Oct. 28, 1986
No. 90/001,231, May 1, 1987

Reexamination Certificate for:

| | |
|---|---|
| Patent No.: | 4,472,010 |
| Issued: | Sep. 18, 1984 |
| Appl. No.: | 462,461 |
| Filed: | Jan. 31, 1983 |

[51] Int. Cl.[4] ..... H01R 39/08
[52] U.S. Cl. ..... 439/19; 439/638; 439/660
[58] Field of Search ..... 339/8 R, 8 P, 8 PB, 339/154 A, 176 M; 179/198; 439/676, 13, 17–30

[56] References Cited

U.S. PATENT DOCUMENTS

| | | | |
|---|---|---|---|
| 1,174,379 | 3/1916 | Bacon | 339/8 PB |
| 2,414,957 | 1/1947 | Larrabure | 339/8 PB |
| 2,459,032 | 1/1949 | Korth | 339/8 P |
| 2,582,800 | 1/1952 | Sorenson | 439/30 |
| 2,832,940 | 8/1958 | Furpahs | 339/8 P |
| 3,430,180 | 2/1969 | Brown | 339/8 R |
| 3,437,976 | 4/1969 | Nelson | 339/8 R |
| 3,699,498 | 10/1972 | Hardesty et al. | 339/64 M |
| 4,003,616 | 1/1977 | Springer | 339/8 R |
| 4,362,905 | 12/1982 | Ismak | 179/1 PC |

FOREIGN PATENT DOCUMENTS

| | | | |
|---|---|---|---|
| A060477 | 4/1959 | France | 439/21 |
| 474793 | 11/1937 | United Kingdom | 439/13 |

OTHER PUBLICATIONS

*Federal Register*, vol. 41, No. 134, Jul. 12, 1976, pp. 28694–28707.

*Primary Examiner*—Eugene F. Desmond

[57] ABSTRACT

A telephone set includes a coiled multi-conductor cable connected to an assembly such as a handset by a standard modular connector and an appliance is interposed in the connector to inhibit twisting of the cable. The appliance includes two parts which freely rotate relative to each other with one part receiving the male element of the connector and the other part being inserted into the female element of the connector so that, rather than the cable twisting, the parts of the appliance rotate relative to each other. The electrical connection between the conductors in the cable and conductors in the handset is maintained by cooperating contacts on the other part and on the female element and by wipers carried by one of the parts and engaging conductive rings on the other part.

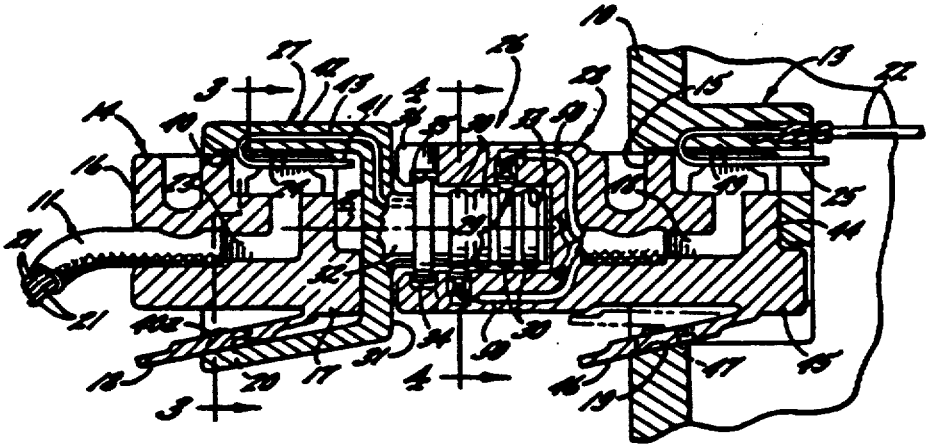

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 4, 5 and 7 are determined to be patentable as amended.

Claims 2, 3 and 6, dependent on an amended claim, are determined to be patentable.

New claims 8–14 are added and determined to be patentable.

1. A twist-inhibiting appliance for use on a telephone set [or the like] which has a multi-conductor cable extending from a base to a handset with first male and female modular connector elements normally adapted to interfit with each other at *one* end of said cable, *said first male and female modular elements having nutually cooperable means requiring a single predetermined orientation of said first elements to enable interfitting with each other,* each of said elements having a preselected number of *substantially shielded but* externally exposed terminals with the terminals on one element engaging the terminals on the other when the [terminals] *elements* interfit, said appliance having, in combination, first and second parts with one part *including a longitudinally extending body portion having a generally circular outer peripheral surface and* captivated within the other *part* and with one part free to rotate about a longitudinal axis relative to the other part, a second male modular connector element *formed* at the extremity of one of said parts adapted to interfit with said first female element *when disposed in said predetermined orientation therewith,* a second female modular connector element *formed* at the extremity of the other of said parts adapted to interfit with said first male element *when disposed in said predetermined orientation therewith,* said second *modular* elements each having *a plurality of substantially shielded but* externally exposed terminals engageable with the terminals on the corresponding ones of said first elements, a plurality of *electrically conductive annular* rings carried by said first part *on the outer periphery of said longitudinal body portion* and electrically connected to the respective terminals of the *second modular* element on such part, a plurality of wipers carried by said second part and electrically connected to the respective terminals of the *second modular* element on such part, said wipers being respectively in sliding contact with the rings on said first part as the two parts turn relatively about said axis, whereby the male and female elements of said appliance may be plugged into the female and male elements of said telephone set to maintain the original connections of said cable [but] *and* with [any] *relative rotation of said parts preventing* twisting of said cable [being automatically removed by relative rotation of said parts].

4. A twist-inhibiting appliance for use on a telephone set [or the like] which has a multi-conductor cable extending from a base to a handset with first male and female modular connector elements normally adapted to interfit with each other at one end of said cable, *said first male and female modular elements having mutually cooperable means requiring a single predetermined orientation of said first elements to enable interfitting with each other,* each of said elements having a preselected number of *substantially shielded but* externally exposed terminals with the terminals on one element engaging the terminals on the other when the *elements* [terminals] interfit, said appliance having, in combination, first and second parts with one part having a *body portion extending generally coaxially within the other part and having a* radial flange, *said body portion being* captivated within the other *part* and with one part free to rotate relative to the other part about the longitudinal axis of said flange, *said body portion having a substantially planar surface facing axially,* a second male modular connector element at the extremity of one of said parts adapted to interfit with said first female element *when disposed in said predetermined orientation therewith,* a second female modular connector element at the extremity of the other of said parts adapted to interfit with said first male element *when disposed in said predetermined orientation therewith,* said second *modular* elements each having *a plurality of substantially shielded but* externally exposed terminals engageable with the terminals on the corresponding ones of said first elements, a plurality of *electrically conductive annular* [conductive] rings carried *by said axially facing planar surface in substantially coplanar relation* [concentrically] *concentric* with said axis [by said first part] and electrically connected to the respective terminals of the *connector* element on such part, a plurality of conductive wipers carried by *the other of* said [second parts] *part* and electrically connected to the respective terminals of the *connector* element on such part, said wipers being respectively in sliding contact with the rings on said [first] *one* part as the two parts turn relatively about said axis, whereby the male and female elements of said appliance may be plugged into the female and male elements of said telephone set to maintain the original connections of said cable [but] *and* with [any] *relative rotation of said parts preventing* twisting of said cable [being automatically removed by relative rotation of said parts].

5. [An] *A twist-inhibiting* appliance [as defined in claim 4 in which] *for use on a telephone set which has a multiconductor cable extending from a base to a handset with first male and female modular connector elements normally adapted to interfit with each other at one end of said cable, each of said elements having a preselected number of externally exposed terminals with the terminals on one element engaging the terminals on the other when the terminals interfit, said appliance comprising, in combination, first and second parts with one part having a radial flange captivated within the other and with one part free to rotate relative to the other part about the longitudinal axis of said flange, a second male modular connector element at the extremity of one of said parts adapted to interfit with said first female element, a second female modular connector element at the extremity of the other of said parts adapted to interfit with said first male element, said second elements each having externally exposed terminals engageable with the terminals on the corresponding ones of said*

*first elements, a plurality of conductive rings carried concentrially with said axis by one of said parts and electrically connected to the respective terminals of the connector element on such part,* said rings [are] *being* equal in diameter and [are] axially spaced along said axis, *a plurality of conductive wipers carried by the other of said parts and electrically connected to the respective terminals of the connector element on such part, said wipers being respectively in sliding contact with the rings on said one part as the two parts turn relatively about said axis,* and spring means [urges] *urging* said wipers radially into engagement with said rings, *whereby the male and female elements of said appliance may be plugged into the female and male elements of said telephone set to maintain the original connections of said cable with twisting of said cable being automatically removed by relative rotation of said parts.*

7. [An] *A twist-inhibiting* appliance [as defined in claim 4 in which said] *for use on a telephone set which has a multi-conductor cable extending from a base to a handset with first male and female modular connector elements normally adapted to interfit with each other at one end of said cable, each of said elements having a preselected number of externally exposed terminals with the terminals on one element engaging the terminals on the other when the elements interfit, said appliance comprising, in combination, first and second parts with one part having a radial* flange [is received in] *captivated within* an annular space formed in said other part and *with one part free to rotate relative to the other part about the longitudinal axis of said flange,* said other part [is] *being* resilient *so as* to yield and permit said flange to enter said space during assembly, *a second male modular connector element at the extremity of one of said parts adapted to interfit with said first female element, a second female modular connector element at the extremity of the other of said parts adapted to interfit with said first male element, said second elements each having externally exposed terminals engageable with the terminals on the corresponding ones of said first elements, a plurality of electrically conductive rings carried concentrically with said axis by said first part and electrically connected to the respective terminals of the element on such part, a plurality of conductive wipers carried by said second part and electrically connected to the respective terminals of the element on such part, said wipers being respectively in sliding contact with the rings on said first part as the two parts turn relatively about said axis, whereby the male and female elements of said appliance may be plugged into the female and male elements of said telephone set to maintain the original connections of said cable with relative rotation of said parts preventing twisting of said cable.*

*8. A twist-inhibiting appliance for use on a telephone set which has multi-conductor cable extending from a base to a handset with first male and female modular connector elements normally adapted to interfit with each other at one end of said cable, said first male and female modular elements having mutually cooperable means requiring a single predetermined orientation of said first elements to enable interfitting with each other, each of said connector elements having a preselected number of substantially shielded but externally exposed terminals with the terminals on one element engaging the terminals on the other when the connector elements interfit, said appliance comprising, in combination, first and second parts with one part captivated within the other and with one part free to rotate about a longitudinal axis relative to the other part, one of said parts having a second male modular connector element formed thereon at the extremity thereof adapted to releasably interfit with said first female connector element when disposed in said predetermined orientation therewith, a second female modular connector element at the extremity of the other of said parts adapted to releasably interfit with said first male connector element when disposed in said predetermined orientation therewith, said second modular connector elements each having a plurality of substantially shielded but externally exposed terminals engageable with the terminals on the corresponding ones of said first elements, a plurality of electrically conductive annular planar rings carried by said first part in concentric coplanar relation with each other so as to face axially, discrete conductor element means electrically interconnecting each of said conductive rings to a respective terminal of the connector element on such part, a plurality of discrete conductive wipers carried by said second part and electrically connected to the respective terminals of the connector element on such part; said wipers being respectively in resiliently biased sliding contact with respective ones of said conducting planar rings on said first part as the two parts turn relatively about said axis, whereby the male and female connector elements of said appliance may be releasably plugged into the female and male connector elements of said telephone set to maintain the original connections of said cable and with relative rotation of said parts preventing twisting of said cable.*

*9. An appliance as defined in claim 8 including spring means urging said wipers into engagement with said conductive rings.*

*10. An appliance as defined in claim 1 wherein said first male connector element includes an externally projecting spring finger, said first female connector element having means cooperative with said spring finger so as to releasably retain said first connector elements in interfitted relation, said second female connector element having means cooperative with said spring finger on said first male connector element so as to enable releasable retention of said first male connector element in interfitted relation with said second female connector element.*

*11. An appliance as defined in claim 1 wherein said multi-conductor cable includes four conductors, each of said first male and female modular connector elements having four exposed terminals, and said second modular connector elements each having four exposed terminals engageable with the four terminals on the corresponding ones of said first connector elements when interfitted therewith.*

*12. An appliance as defined in claim 4 wherein said radial flange has an outer diameter greater than any of said conductive rings.*

*13. An appliance as defined in claim 12 wherein said radial flange is formed generally peripherally of said conductive rings.*

*14. A twist-inhibiting appliance for use on a telephone set which has a multi-conductor cable extending from a base to a handset with first male and female modular connector elements normally adapted to interfit with each other at one end of said cable, said first male and female modular elements having mutually cooperable means requiring a single predetermined orientation of said first elements to enable interfitting with each other, each of said elements having a preselected number of substantially shielded but externally exposed terminals with the terminals on one element engaging the terminals on the other when the elements interfit, said appliance having, in combination, first and second parts with one part having a body portion extending generally coaxially within the other part and*

*having a radial flange and a substantially planar surface facing axially, and with one part free to rotate relative to the other part about the longitudinal axis of said flange, a second male modular connector element carried by one of said parts in axially spaced relation from the other part adapted to interfit with said first female element when disposed in said predetermined orientation therewith, a second female modular connector element carried by the other of said parts in opposed axially spaced relation adapted to interfit with said first male element when disposed in said predetermined orientation therewith, said second modular elements each having a plurality of substantially shielded but externally exposed terminals engageable with the terminals on the corresponding ones of said first elements, a plurality of electrically conductive annular rings supported by said axially facing surface in substantially coplanar relation concentric with said longitudinal axis and electrically connected to the respective terminals of the connector element on such part, a plurality of conductive wipers carried by the other of said parts and electrically connected to the respective terminals of the connector element on such part, said wipers being respectively in sliding contact with the rings on said one part as the two parts turn relatively about said axis, whereby the male and female elements of said appliance may be plugged into the female and male elements of said telephone set to maintain the original connections of said cable and with relative rotation of said parts preventing twisting of said cable.*

• • • • •